United States Patent [19]

Koller, Jr.

[11] 4,032,392

[45] June 28, 1977

[54] METHOD OF INCREASING THE FREENESS OF ASBESTOS SLURRIES

[75] Inventor: Frank J. Koller, Jr., Lancaster, Pa.

[73] Assignee: Armstrong Cork Company, Lancaster, Pa.

[22] Filed: Aug. 6, 1976

[21] Appl. No.: 712,148

[52] U.S. Cl. ..... 162/155; 162/168 R; 162/169; 162/183

[51] Int. Cl.[2] ..... D21F 11/00

[58] Field of Search ..... 162/155, 168 R, 169, 162/183

[56] References Cited

UNITED STATES PATENTS

| | | | |
|---|---|---|---|
| 2,485,458 | 10/1949 | Quinn et a. | 162/155 |
| 2,868,641 | 1/1959 | Feigley | 162/155 |
| 3,153,610 | 10/1964 | Heiser et al. | 162/183 |
| 3,694,281 | 9/1972 | Leduc | 162/155 |

FOREIGN PATENTS OR APPLICATIONS

| | | | |
|---|---|---|---|
| 1,338,759 | 11/1973 | United Kingdom | 162/169 |

*Primary Examiner*—Robert L. Lindsay, Jr.
*Assistant Examiner*—Peter Chin

[57] ABSTRACT

This invention represents an improvement in the method for making beater-saturated products by forming a slurry of asbestos fibers in water, precipitating a synthetic, non-film forming, organic binder in particulate form on said fibers to form a slurry of coated fibers, draining the slurry of coated fibers and forming a product therefrom. The improvement in accordance with this invention comprises controlling the drainage time of the slurry of coated fibers by adding to such slurry a film-forming secondary binder.

5 Claims, No Drawings

METHOD OF INCREASING THE FREENESS OF ASBESTOS SLURRIES

BACKGROUND OF THE INVENTION

1 Field of the Invention

This invention relates generally to an improvement in the processing of fiber slurries which are saturated with a fire retardant particulate organic binder by a beater-saturating technique. More particularly, this invention relates to a method of improving the drainage time of beater-saturated asbestos slurries while yielding fire retardant products requiring no post-saturation.

2. Description of the Prior Art

Most processinng plants need to remove rather large quantities of low-value heat. Industrial cooling towers, rectangular structures usually made of redwood and measuring roughly 50 feet high, 60 feet wide and several hundred feet long, have been familiar sights around such plants for many years. Modern cooling towers, i.e. the hyperbolic tower, are, however, gradually replacing the older, less efficient rectangular structures. These towers operate by allowing ambient air to pass over the hot process water, thereby carrying away its process heat. The hot process water, from the plant's condenser and other equipment, splashes down through heat transfer plates, such as against an upward flow of air from ducts at the bottom of the tower. The cooled water is collected at the base of the tower and circulated back to the processing plant for reuse. The heat transfer plates, sometimes called fill materials, are usually of specific shape and dimensions so as to maximize the surface area of the downwardly flowing process water thereby, in turn, maximizing the contact with the upwardly flowing cooling air. While a variety of materials have been used as such heat transfer plates, the most economical have been rigid, corrugated sheets of treated paper-like materials. In order to operate satisfactorily in these cooling systems, it is essential to have available a fill material that is not only economical in cost but also fire retardant and dimensionally stable, e.g., it does not lose its effective heat transfer shape under conditions that arise normally from the operation of cooling towers.

One of the most successful of the paper-like materials used as cooling tower fill are asbestos paper. Such cooling tower fill papers are advantageously made by the widely recognized beater saturation process so commonly used in the paper-making industry. In this process, various binders are added to the beater saturation slurry of asbestos in order to achieve interfiber bonding, such binder precipitating and coating the asbestos fibers. These binders are preferably added to the aqueous slurry as resin emulsions or latices. After draining, the asbestos sheets are saturated with a melamine or phenolic resin to impart rigidity. They are then formed into the desired (usually corrugated) shape, dried and cured so as to give the desired fire-retardant board useful as cooling tower fill. The resulting asbestos sheets adhered with the latices and resin emulsions have proven economically disadvantageous for tower fill substances, principally because of the necessity for the additional post-saturating step after paper formation so as to develop sufficient rigidity in the final product.

In an attempt to obviate this problem, e.g., to eliminate the post-saturation step necessary to give a sufficient rigidity and shape retention characteristics to the fill material, asbestos sheets containing fire-retardant, chlorinated polymers such as poly(vinyl chloride) have been utilized. While these vinyl materials enjoy commercial attraction in terms of the elimination of the post-saturation step, the processing conditions for beater-saturated asbestos fibers using PVC binder latices have been shown to provide drain times that are excessive and, therefore, cannot be economically used on conventional paper-making machines.

Accordingly, there is a need for a cooling tower fill material that is fire retardant as well as rigid at cooling tower operating conditions, such formed by a beater saturation process in which the binder-coated asbestos slurry is quick draining.

SUMMARY OF THE INVENTION

It is an object of this invention to provide an improved method for enhancing the drainage time of organic binder particulate coated beater-saturated slurries.

It is another object of the present invention to provide an improved method for enhancing the drain time of poly(vinyl chloride) coated asbestos fibers without any pretreatment of the asbestos fibers.

These and other objects of the present invention will become apparent in the following description and claims.

DESCRIPTION OF THE PREFERRED EMBODIMENTS

The present invention is directed to the preparation of an asbestos sheet wherein a latex of an unplasticized, poly(vinyl chloride) polymer or poly(vinyl chloride)/-vinyl acetate copolymer is added to an aqueous slurry of asbestos fibers, the solid poly(vinyl chloride) polymer or copolymer in the latex being precipitated onto the asbestos fibers and the resulting slurry of fibers thereafter formed into a sheet, the improvement which comprises adding a second latex to the slurry of asbestos and effecting the precipitation of the poly(vinyl chloride) polymer onto the asbestos fiber in the presence of the second latex, a secondary binder. For simplicity, the term poly(vinyl chloride) as used herein includes both the commercially available homopolymers as well as the commercially available copolymers formed with vinyl chloride and vinyl acetate. These polymeric latices are noted in the prior art as non-film-forming materials, as hereinafter described.

The term secondary binder used in this specification signifies compounds that are polymeric in nature, have good film-forming properties, and tend to agglomerate asbestos fibers. The term film-forming properties denotes the ability of the latex form of the secondary binder to form a film when such is drawn down by a doctor blade or the like on a release surface, no further treatment being necessary, e.g. such as heat or pressure, so as to form the film. These film-forming latices can be advantageously selected from any of the fire-retardant, halogenated, commercially available polymers. Particularly preferable in accordance with the method of this invention, are those latex compositions formed of polyvinylidene chloride polymers and copolymers. These are prepared by polymerization of vinylidene chloride, or vinylidene chloride and a comonomer such as butadiene ethylacrylate, propylacrylate, butylacrylate, octylacrylate and the like in an aqueous emulsion by well-known techniques which are disclosed in numerous references. The solids content of the polyvinyldene chloride homopolymerized and copolymerized latices usually range from about 40% to about 60%.

In practicing the process of this invention, the ratio of asbestos to total binder can be from 4:1 to 1:1. If ratios lower then this range are used, then the resulting asbestos sheets are not adequately rigid or sufficiently heat formable to serve as cooling tower fill. Higher ratios than disclosed herein are economically wasteful since it becomes difficult to completely precipitate the polymers on the asbestos fibers. The ratio of secondary binder to primary binder, i.e. homopolymerized or copolymerized polyvinylidene chloride to poly(vinyl chloride) polymer, can be in the range of from 10:90 to 25:75. Preferably from about 15:85 to 25:75 is useful in practicing the improvement in accordance with this invention.

The method used to bring the secondary binder, the primary binder and the asbestos together may be varied considerably. The asbestos slurry and the poly(vinyl chloride) latex may first be blended and the secondary biner latex may then be added to the mixture (Method I). Alternatively, the secondary binder latex may be added to the asbestos slurry before the addition of the poly(vinyl chloride) latex (Method II). A third method (Method III) is where both secondary binder latex and poly(vinyl chloride) latex are blended and then added to the asbestos slurry. A variation of Method II may also be employed in which the secondary binder latex is added to the asbestos slurry and this slurry and the poly(vinyl chloride) latex are mixed by a continuous process. In any of the methods used in accordance with the present invention, it is unnecessary to pretreat the asbestos fibers in order to improve the retention of binder thereon. These three methods will now be discussed in greater detail.

METHOD I

In using this method, an aqueous slurry of asbestos fibers is prepared by conventional methods. The asbestos content of the slurry usually ranges from about 1% to 2% depending on the mixing equipment to be used, the size of the asbestos fibers, the time cycle to be used, and the like. The most important consideration is that the consistency be such as to permit adequate circulation of the asbestos fibers without settling or forming of stagnant areas. The selection of the proper consistency is one that is well recognized and known to those skilled in the art.

The poly(vinyl chloride) latex is then added to the asbestos slurry. This poly(vinyl chloride) latex, also commercially available, may have in it stabilizers, plasticizers, fillers, suspending agents and the like. The amount of poly(vinyl chloride) latex added at this point should be from about 20% to 80% by weight of asbestos. Preferably from about 30% to 45% poly(vinyl chloride) latex is used in this method. The solids content of such latex is not critical. Where practical or necessary, the latex may be diluted with an equal weight of water to facilitate mixing, however, this is not essential. It is preferable to add the asbestos slurry while agitating the latex so as to prevent build up of high local concentrations of latex. After a suitable time has elapsed allowing thorough distribution and precipitation of the latex, the secondary binder latex is then added. Such addition should also occur as the asbestos is being mixed so as to prevent high concentrations in any one location. The concentration of solids in the secondary binder latex is not critical, but it is preferred to use a concentration of 45% to 50%.

The total amount of secondary binder latex required also varies somewhat with the degree of draining required. In general, it has been found that a ratio of from 85:15 to 75:25 poly(vinyl chloride) latex:secondary binder latex, based on dry weight, should be used to effect reasonably fast draining, i.e., less than about 60 seconds. Mixing should be continued until the aqueous phase of the asbestos-latex dispersion becomes clear.

METHOD II

In Method II, the asbestos slurry is prepared as in Method I. The desired amount of secondary binder latex is then added to the slurry.

The poly(vinyl chloride) latex composition is then added to the asbestos slurry. As in Method I, it is most preferred to use at least 15 parts of the secondary binder per 85 parts of primary binder, both parts being by dry weight. The latex is compounded as described under Method I.

METHOD III

Method III utilizes a premix of poly(vinyl chloride) latex and secondary binder latex. This premix is then added to the asbestos slurry. The amount of the two latices to be added can be varied widely in the premix. Generally, the premix comprises 15 to 25 parts of secondary binder:85 to 75 parts of poly(vinyl chloride) primary binder solids. The premix of latices are then added to the asbestos slurry.

In the prior art it has been found sometimes necessary to add to the latices a stabilizing agent which makes it possible to use latices of somewhat higher polymer content. Such stabilizing agents prevent too rapid precipitation of the polymer latices when such come in contact with the asbestos slurry. In the method in accordance with the present invention, such stabilizing agent addition is not necessary.

After the polymers have been precipitated onto the asbestos fiber by one of Methods I, II, or III, the suspension is transferred to a screen through which water drains and is then compacted into sheets by conventional means. It has been found that when polyvinylidene chloride copolymers are used in conjunction with poly(vinyl chloride) homopolymers or poly(vinyl chloride)/vinyl acetate copolymers latices, the drain time of asbestos is much shorter than when poly(vinyl chloride) latices (or poly(vinyl chloride)/vinyl acetate copolymer latices) alone are used. This expedites the sheet-making process.

Representative examples illustrating the present invention follow.

EXAMPLE 1

This example illustrates the use of Method I described above. 30 gms 7D asbestos was slurried with 1700 ml water. To the slurry was added 11.25 gms PVC copolymer latex (dry weight) Geon 460X6. The mixture was agitated for 3 minutes and 3.75 gms vinylidene chloride copolymer latex (dry weight) Geon 660X1 was added. The primary:secondary binder is 75:25. The resulting mixture was agitated for a further 3 minutes until clear and formed into a sheet on a screen measuring 12 inches × 12 inches. Drain time for such slurry on the screen was 24 seconds.

EXAMPLE 2

Example 1 was repeated, substituting 5R asbestos for that of the above example. Drain time, 17 seconds.

EXAMPLE 3

This example illustrates the use of Method II. 30 gms 5R asbestos was slurried with 3000 ml water. To this slurry was added 3.0 gms vinylidene chloride copolymer latex (dry weight) Geon 660X1 and agitation was carried out for 3 minutes. 12.0 gms PVC copolymer latex (dry weight) Geon 460X6 was then added and agitation continued until the aqueous phase was clear. The resulting mix was formed into a sheet on a screen as in Example I. Drain time, 30 seconds.

EXAMPLE 4

This example illustrates Method III. 30 gms 5R asbestos was slurried with 3000 ml water. A blend of 12.75 gms PVC homopolymer latex (dry weight) Geon 151 and 2.25 gms vinylidene chloride copolymer latex (dry weight) Geon 660X4 was then added with agitation. Mixing was continued until the aqueous phase became clear (about 3 minutes). The resulting mix was formed into a sheet as in the earlier examples. Drain time, 22.5 seconds.

The method disclosed in Examples 1 and 4 were repeated for various PVC:secondary binder to illustrate further the invention. The results are as follows:

Method I

| Example | PVC copolymer[1] :secondary binder[2] ratio (added separately) | Drain Time (Seconds) | Canadian Freeness (ml.) |
|---|---|---|---|
| Comparison | 100:0 | 225 | 80 |
| 5 | 90:10 | 55 | 280 |
| 6 | 85:15 | 40 | 350 |
| 7 | 80:20 | 24 | 480 |
| 1 | 75:25 | 20 | 550 |

METHOD III

| Example | PVC copolymer[3] :secondary binder[4] ratio (blended before addition) | Drain Time (Seconds) | Canadian Freeness (ml.) |
|---|---|---|---|
| Comparison | 100:0 | 129 | 100 |
| 8 | 90:10 | 35 | 330 |
| 9 | 85:15 | 22.5 | 470 |
| 10 | 80:20 | 15 | 550 |
| 4 | 75:25 | 10 | 650 |

Drain times measured in a standard Williams 12" × 12" sheet mold.

[1]Geon 460X6 (B. F. Goodrich) vinyl chloride/vinyl acetate copolymer Tg 73° C. (differential scanning calorimetry (DSC)) Mn 29,800, Mw 104,000, Mz 290,000 (gel permeation chromotography (GPC))

[2]Geon 660X1 (B. F. Goodrich) vinylidene chloride/acrylate copolymer Tg 7° C. (DSC) Mn 30,700, Mw 123,000, Mz 385,000 (GPC)

[3]Geon 151 (B. F. Goodrich) Tg 85° C. (DSC)Mn 24,600, Mw 125,000, Mz 347,000 (GPC)

[4]Geon 660X4 (B. F. Goodrich) vinylidene chloride/acrylate copolymerTg −10° C. (DSC)

The stiffness of the sheets formed by Method I was evaluated to illustrate that the method in accordance with the present invention, while improving drain times significantly had little effect on this important physical property.

| Example | OLSEN STIFFNESS .027" SHEET THICKNESS Geon 460X6/660X1 Ratio | In.-Lbs. at 20° Angle |
|---|---|---|
| Comparison | 100/0 | .120 |
| 5 | 90/10 | .141 |
| 6 | 85/15 | .144 |
| 7 | 80/20 | .130 |
| 1 | 75/25 | .140 |
| Comparison | 0/100 | .026 |

As many apparently wide and different embodiments of this invention may be made without departing from the spirit and scope thereof, it is to be understood that this invention is not limited to the specific embodiments thereof except as defined in the appended claims.

What is claimed is:

1. In a method of making beater-saturated asbestos sheets by forming a slurry of asbestos fibers in water, precipitating a synthetic non-film-forming organic binder in particulate form on said fibers to form a slurry of coated fibers, draining said slurry of coated fibers and forming a product therefrom, the improvement in controlling said draining comprising adding to the slurry of coated fibers a film-forming secondary binder of poly(vinylidene chloride) or copolymers thereof wherein said synthetic, non-film-forming organic binder and said film-forming secondary binder of poly(vinylidene chloride) or copolymers thereof are first blended in a ratio of about 85:15 to 75:25 and added to said slurry of asbestos fibers in water.

2. A method for forming a beater-saturated asbestos sheet which comprises the steps of:

a. forming an aqueous slurry of asbestos fiber;

b. adding a synthetic latex to the slurry, said latex comprising a blend of a synthetic non-film-forming organic binder and a synthetic film-forming secondary binder of poly(vinylidene chloride) or copolymers thereof, said non-film-forming organic binder: film-forming secondary binder in a ratio of 85:15 to about 75:25; wherein said latex is evenly coated on said asbestos fibers; and c. draining the coated asbestos fibers, thereby forming an asbestos sheet, said draining having a drain time of less than about 60 seconds as measured in a standard Williams 12 inches × 12 inches sheet mold.

3. The asbestos sheet made by the method of claim 2.

4. A method for forming a beater-saturated asbestos sheet which comprises the steps of a. forming an aqueous slurry of asbestos fiber;

b. adding to the slurry a synthetic non-film-forming organic binder;

c. adding to the slurry formed in step (b) a synthetic film-forming secondary binder of poly(vinylidene chloride) or copolymers thereof, said synthetic non-film-forming organic binder:synthetic film-forming secondary binder in a ratio of 85:15 to about 75:25;

d. draining the slurry formed in step (c), thereby forming an asbestos sheet, said draining having a drain time of less than about 60 seconds as measured in a standard Williams 12 inches × 12 inches sheet mold.

5. The asbestos sheet made by the method of claim 4.

* * * * *